US005761593A

United States Patent [19]

Ostlund et al.

[11] Patent Number: 5,761,593

[45] Date of Patent: Jun. 2, 1998

[54] PROCESS FOR MAKING A CEMENTED CARBIDE WITH BINDER PHASE ENRICHED SURFACE ZONE

[75] Inventors: Ake Ostlund, Taby; Ulf Oscarsson, Tumba; Per Gustafson, Huddinge; Leif Akesson, Alvsjo, all of Sweden

[73] Assignee: Sandvik AB, Sandviken, Sweden

[21] Appl. No.: 616,312

[22] Filed: Mar. 15, 1996

Related U.S. Application Data

[62] Division of Ser. No. 258,598, Jun. 10, 1994, Pat. No. 5,549,980, which is a continuation of Ser. No. 19,701, Feb. 19, 1993, abandoned.

[30] Foreign Application Priority Data

Feb. 21, 1992 [SE] Sweden ..... 9200530

[51] Int. Cl.[6] ..... C21D 1/00

[52] U.S. Cl. ..... 419/29; 419/57; 419/60

[58] Field of Search ..... 419/14, 29, 60, 419/57; 148/206, 207

[56] References Cited

U.S. PATENT DOCUMENTS

| | | | |
|---|---|---|---|
| 4,277,283 | 7/1981 | Tobioka et al. | 75/238 |
| 4,548,768 | 10/1985 | Ramser et al. | 264/12 |
| 4,610,931 | 9/1986 | Nemeth et al. | 428/547 |
| 4,649,084 | 3/1987 | Hale et al. | 428/552 |
| 4,705,124 | 11/1987 | Abrahamson et al. | 175/410 |
| 4,743,515 | 5/1988 | Fischer et al. | 428/698 |
| 4,812,370 | 3/1989 | Okada et al. | 428/552 |
| 4,830,930 | 5/1989 | Taniguchi et al. | 428/547 |
| 4,843,039 | 6/1989 | Akesson et al. | 501/87 |
| 4,990,410 | 2/1991 | Saitoh et al. | 428/547 |
| 5,283,030 | 2/1994 | Nalcano et al. | 419/53 |

*Primary Examiner*—Ngoclan Mai

*Attorney, Agent, or Firm*—Burns, Doane, Swecker & Mathis, L.L.P.

[57] ABSTRACT

A cemented carbide insert with improved toughness and resistance against plastic deformation containing WC and cubic phases of carbide and/or carbonitride in a binder phase based on Co and/or Ni with a binder phase enriched surface zone is disclosed. The binder phase content in the insert is 3.5–12 weight-%. In a zone below the binder phase enriched surface zone, the binder phase content is 0.85–1 of the binder phase content in the inner portion of the insert and the content of cubic phases is essentially constant and equal to the content in the inner portion of the insert. The insert is formed by sintering a cemented carbide containing a nitrogen-containing material in a vacuum or inert atmosphere and heat treating the sintered insert in nitrogen at 40–400 mbar at a temperature of 1280°–1430° C. for a time of 5–100 min.

6 Claims, 2 Drawing Sheets

A

B

A

B

PROCESS FOR MAKING A CEMENTED CARBIDE WITH BINDER PHASE ENRICHED SURFACE ZONE

This application is a divisional of application Ser. No. 08/258,598, filed Jun. 10, 1994, U.S. Pat. No. 5,549,980. Which is a continuation of application Ser. No. 08/019,701, filed Feb. 19, 1993 abandoned.

BACKGROUND OF THE INVENTION

The present invention relates to coated cemented carbide inserts with a binder phase enriched surface zone and a process for the making of the same. More particularly, the present invention relates to coated inserts in which the cemented carbide has been modified so that unique technological properties have been obtained at a given chemical composition and grain size regarding the balance between very good toughness behavior and high resistance against plastic deformation.

Coated cemented carbide inserts with binder phase enriched surface zone are today used to a great extent for machining of steel and stainless materials. Thanks to the binder phase enriched surface zone, an extension of the application area for the cutting tool material has been obtained.

Methods or processes to make cemented carbide containing WC, cubic phase (gamma-phase) and binder phase with binder phase enriched surface zones are within the techniques referred to as gradient sintering and are known through a number of patents and patent applications. According to, e.g., U.S. Pat. Nos. 4,277,283 and 4,610,931, nitrogen-containing additions are used and sintering takes place in vacuum whereas according to U.S. Pat. No. 4,548,768, the nitrogen is added in gas phase. In both cases, a binder phase enriched surface zone essentially depleted of cubic phase is obtained. U.S. Pat. No. 4,830,930 describes a binder phase enrichment obtained through decarburization after the sintering whereby a binder phase enrichment is obtained which also contains cubic phase.

In U.S. Pat. No. 4,649,084, nitrogen gas is used in connection with the sintering in order to eliminate a process step and to improve the adhesion of a subsequently deposited oxide coating.

From a fracture mechanics point of view, an enrichment of binder metal in a surface zone means that the ability of the cemented carbide to absorb deformation and stop growing cracks increases. In this way, a material is obtained with an improved ability to withstand fracture by allowing greater deformations or by preventing cracks from growing, compared to a material with mainly the same composition but homogeneous microstructure. The cutting material, thus, obtains a tougher behavior.

When gradient sintering according to the known technique of vacuum sintering of a nitrogen-containing cemented carbide, the nitrogen is usually added by adding a small amount of nitrogen-containing raw materials. Due to the fact that the nitrogen activity in the furnace atmosphere at the sintering is below the average nitrogen activity in the cubic phase, the nitrogen-containing cubic phase will give off nitrogen through the liquid binder phase to the furnace atmosphere. There is a certain disagreement about the kinetics in this dissolution process. The opinion seems to be that when the nitrogen leaves, this generates conditions for a complete dissolution of the cubic phase in the surface zone of the material. The process is thought to be controlled by diffusion of nitrogen and by diffusion of the metal components of the cubic phase. Regardless, the result is that the volume which previously was occupied by the cubic phase after its dissolution is occupied by liquid binder metal. Through this process, a binder phase enriched surface zone is created after the solidification of the binder phase. The metal components in the dissolved cubic phase diffuse inwardly and are precipitated on available undissolved cubic phase present further in the material. The content of these elements therefore increases in a zone inside the binder phase enriched surface zone at the same time as a corresponding decrease in the binder phase content is obtained.

A characteristic distribution of Co, Ti and W as a function of the distance from the surface of a cemented carbide with binder phase enrichment obtained through the above-mentioned process appears, e.g., from FIG. 1 in U.S. Pat. No. 4,830,930. Outermost, there is a surface zone enriched in binder phase and completely or partly depleted of cubic phase. Inside this surface zone there is an area with an enrichment of the metallic element(s) present in the cubic phase, in particular Ti, Ta and Nb, and where the binder phase content is considerably lower than the average content of binder phase in the interior of the cemented carbide body. The decrease in binder phase content for cemented carbide with about 6 weight-% cobalt and 9 weight-% cubic phase can be up to about 2 weight-%, i.e., a relative decrease of the order of 30%. Cracks grow easily in this zone, which has a decisive influence on the fracture frequency during machining when the cemented carbide body is used as a metal-cutting insert.

OBJECTS AND SUMMARY OF THE INVENTION

It is an object of this invention to avoid or alleviate the problems of the prior art.

It is further an object of this invention to provide a cemented carbide insert with a greater toughness along with a method for making same.

In one aspect of the invention there is provided a cemented carbide insert with improved toughness and resistance against plastic deformation containing WC and cubic phases of carbide and/or carbonitride in a binder phase based on Co and/or Ni with a binder phase enriched surface zone wherein the total amount of cubic phase expressed as the content of metallic elements that forms cubic carbides is between 6 and 15 weight-%, and in a zone below the binder phase enriched surface zone, the binder phase content is 0.85–1 times the binder phase content in the inner portion of the insert with the content of cubic phases essentially constant and equal to the content of cubic phases in the inner portion of the insert.

In another aspect of the invention there is provided in a method of making a binder phase enriched cemented carbide insert by sintering in said cemented carbide vacuum with a nitrogen-containing material, the improvement wherein after the sintering, the insert is heat treated in nitrogen at 40–400 mbar at a temperature of 1280°–1430° C. for a time of 5–100 min.

DETAILED DESCRIPTION OF THE PREFERRED EMBODIMENTS OF THE INVENTION

Figure 1:
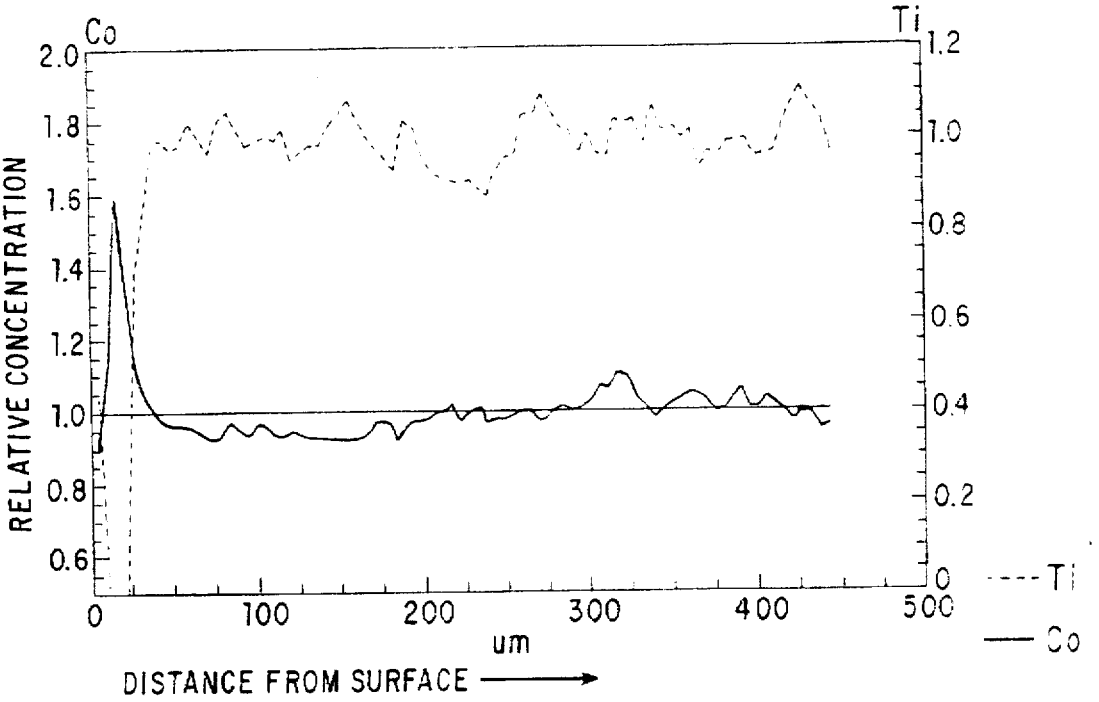
FIG. 1 shows the distribution of Co and Ti as a function of the distance from the surface of a binder phase enriched cemented carbide according to the invention.

It has now turned out that if an essentially vacuum sintered nitrogen-containing cemented carbide with a binder phase enriched surface zone is subjected to a nitrogen gas treatment at a temperature where the binder phase is liquid, the toughness behavior can be further increased. This improvement in toughness is obtained simultaneously as the resistance against plastic deformation remains essentially unchanged. In this way, an insert can be used in applications which today generally require two or more grades of inserts with homogeneous structure to cover the same application area.

The present invention relates to a process performed after gradient sintering comprising the sintering in vacuum or inert atmosphere of a nitrogen-containing cemented carbide either as a separate process step or integrated into the gradient sintering process. The process comprises supplying nitrogen gas to the sintering furnace at a pressure of 40–400 mbar, preferably 150–350 mbar, at a temperature between 1280° and 1430° C., preferably between 1320° and 1400° C. A suitable time for the nitrogen gas treatment is 5–100 min, preferably 10–50 min. The nitrogen gas is maintained until a temperature where the binder phase solidifies at about 1275°–1300° C. The main part of the effect is, however, achieved even if the binder phase solidifies in vacuum or in inert atmosphere. It is particularly suitable to introduce a holding time for the nitrogen gas treatment of 5–50 min at a temperature of 1350°–1380° C. and a pressure of 200–350 mbar for cemented carbides with a content of cubic phase of 6–10 weight-% (expressed as discussed below) or at 1280°–1320° C. at a pressure of 50–150 mbar for a cemented carbide with a content of cubic phase of 8–15 weight-%.

The process according to the present invention is particularly intended to be applied to binder phase enriched cemented carbide made by sintering in vacuum or inert atmosphere at very low pressure of nitrogen of a nitrogen-containing material. It is effective on cemented carbide containing titanium, tantalum, niobium, tungsten, vanadium and/or molybdenum and a binder phase based on Co and/or Ni. An optimal combination of toughness and resistance against plastic deformation is obtained when the total amount of cubic phase expressed as the content of metallic elements forming cubic carbides, i.e., Ti, Ta, Nb, etc., is between 6 and 15 weight-%, preferably between 7–10 weight-%, at a titanium content of 0.4–10 weight-%, preferably 1–4 weight-%, for turning and 2–10 weight-% for milling and when the binder phase content is between 3.5 and 12 weight-% for turning, preferably between 5 and 7.5 weight-%, and for milling, preferably between 6 and 12 weight-%.

The carbon content can be below carbon saturation up to a content corresponding to maximum C08, preferably C02–C08.

With the process according to the present invention, a cemented carbide with improved toughness and resistance against plastic deformation containing WC and cubic phases of carbonitride and/or carbide, preferably containing Ti in a binder phase based on Co and/or Ni with a, preferably <50 μm thick binder phase enriched surface zone can be produced. Immediately inside the binder phase enriched surface zone, there is a <300 μm, preferably <200 μm, thick zone with a binder phase content of 0.85–1, preferably 0.9–1, most preferably 0.92–1, of the binder phase content in the inner portion of the cemented carbide (which is the nominal content of binder phase in the cemented carbide). In this inner thick zone, the content of cubic phase is essentially constant and equal to the cubic phase content in the inner portion of the cemented carbide. The binder phase enriched zone is essentially free from cubic phase, i.e., it contains WC and binder phase except for the very surface where the share of cubic phase is ≦50 volume-%. The binder phase content in the binder phase enriched zone has within a distance from the surface of 10–30 μm a maximum of >1.1, preferably 1.25–2, of the binder phase content in the inner portion of the cemented carbide.

Cemented carbide of the present invention is suitably coated with known thin wear resistant coatings by CVD- or PVD-technique. Preferably a layer of carbide, nitride or carbonitride of, preferably titanium, is applied as the innermost layer. Prior to the coating the cemented carbide is cleaned, e.g., by blasting so that possible graphite and cubic phase are essentially removed.

The present invention improves the properties of the cemented carbide. When used, no zone is obtained in the material where propagation of cracks is favorable. As a consequence, a cemented carbide is obtained with considerably tougher behavior than possible using known techniques. By choosing a cemented carbide composition which has great resistance against plastic deformation, it is thus possible with the present invention to obtain the combination of very good toughness behavior and good resistance to plastic deformation in a way that gives a cemented carbide with unique properties.

The invention is additionally illustrated in connection with the following Examples which are to be considered as illustrative of the present invention. It should be understood, however, that the invention is not limited to the specific details of the Examples.

EXAMPLE 1

From a powder mixture comprising 1.9 weight-% TiC, 1.4 weight-% TiCN, 3.3 weight-% TaC, 2.2 weight-% NbC, 6.5 weight-% Co, and balance WC with 0.15 weight-% overstoichiometric carbon content, turning inserts CNMG 120408 were pressed. The inserts were sintered with $H_2$ up to 450° C. for dewaxing, further in vacuum to 1350° C. and after that protective Ar gas for 1 hour at 1450° C. This part is completely standard sintering.

During the cooling, a treatment according to the invention was made as 30 min at 1375° C. with an atmosphere of 300 mbar $N_2$ and thereafter continued cooling in $N_2$ down to 1200° C. where a gas change to Ar was made.

The structure in the surface of the cutting insert consisted then of a 25 μm thick binder phase enriched zone essentially free from cubic phase and below that a zone slightly depleted of binder phase, 0.92–1 times the content of the binder phase in the inner portion of the insert and without essential enrichment of cubic phase as shown in FIG. 1.

On the very surface of the inserts, particles of cubic phase were present covering about 40% of the surface together with Co, WC and graphite. The inner portion of the inserts showed C-porosity, C04. After conventional edgerounding and cleaning, part of the cubic phase present on the surface was removed. The cutting inserts were coated by conventional CVD-technique with an 8 μm thick layer consisting of TiC and TiN.

EXAMPLE 2

(Reference Example to Example 1)

From the same powder as Example 1, inserts were pressed of the same type. These inserts were sintered according to the standard part of the sintering in Example 1, i.e. with a protective gas of Ar during the holding time at 1450° C. The cooling was under a protective gas of Ar.

Figure 2:
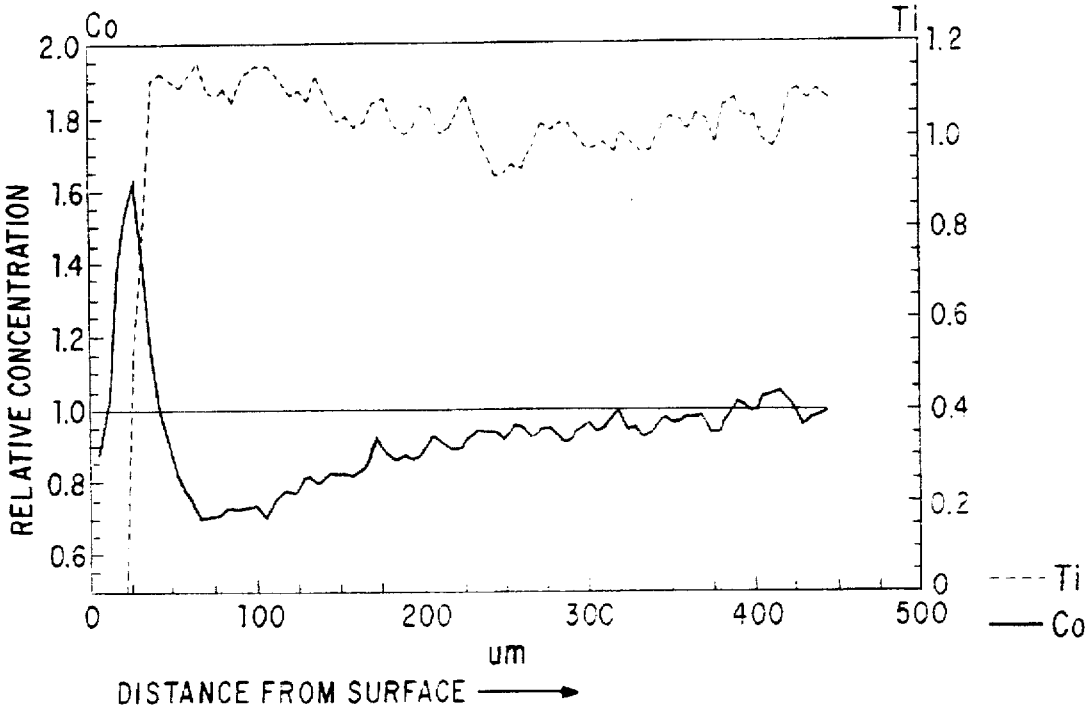
FIG. 2 shows the distribution of Co and Ti as a function of the distance from the surface of a binder phase enriched cemented carbide according to known technique.

The structure in the surface consisted of a 25 μm thick binder phase enriched zone essentially free from cubic phase. Below that zone, a 100–150 μm thick zone considerably depleted of binder phase, with a minimum of about 70% of the nominal content of binder phase in the inner portion of the insert and enriched of cubic phase was found as shown in FIG. 2. The inner of the inserts showed C-porosity, C04. This is a typical structure for gradient sintered cemented carbide according to known technique. The inserts were edgerounded and coated as in Example 1 according to known techniques.

EXAMPLE 3

With the CNMG 120408 inserts from Examples 1 and 2, a test was performed as an interrupted turning operation in an ordinary low carbon steel. The following cutting data were used:

Speed: 80 m/min

Feed: 0.30 mm.rev

Cutting depth: 2.0 mm

Thirty edges of each insert were run until fracture. The average life for the inserts according to the invention was (Example 1) 4.6 min and for the inserts according to known techniques (Example 2) 1.3 min.

EXAMPLE 4

The inserts from Examples 1 and 2 were tested in a continuous turning operation in a quenched and tempered steel with the hardness HB=280. The following cutting data were used:

Speed: 250 m/min

Feed: 0.25 mm/rev

Cutting depth: 2.0 mm

The operation led to a plastic deformation of the cutting edge which could be observed as a wear phase on the clearance face of the insert. The time to obtain a land width of 0.40 mm was measured for five edges each. Inserts according to the invention obtained an average tool life of 10.9 min and according to known techniques, an average tool life of 11.2 min.

From Examples 3 and 4, it is evident that inserts according to the invention show a considerably better toughness behavior than according to known technique without having significantly reduced their deformation resistance.

EXAMPLE 5

From a powder of, in weight-%, 5.5 TiC, 1.9 TiCN, 5 TaC, 2.5 NbC, 9.5 Co and the rest WC with about 0.05% substoichiometric carbon content milling inserts SPKR 1203 EDR were pressed. The inserts were sintered according to Example 1 except that the sintering temperature was 1410° C. and that the treatment during the cooling was performed with the following parameters: 20 min at 1310° C. at an atmosphere of 125 mbar $N_2$.

Figure 3:
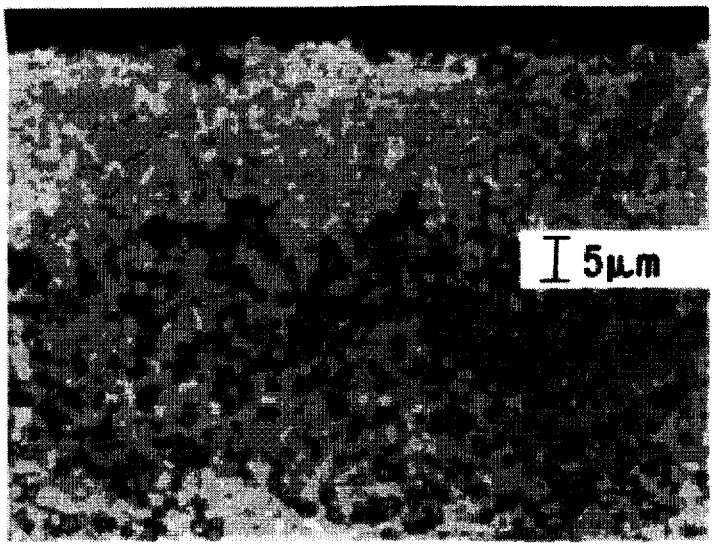
FIG. 3 is a light optical micrograph in 1200× of the surface zone of a cemented carbide according to the invention in which A is surface zone enriched in binder phase and essentially free from cubic phase and B is the upper part of the zone according to the invention.

Examination of the structure showed an about 15 μm thick binder phase enriched zone, essentially free from cubic phase as shown in FIG. 3. Below this surface zone there was a thicker zone insignificantly depleted of binder phase, less than 10% below nominal content.

On the surface there were particles of cubic phase covering <10% together with WC and binder phase. The inserts had no C-porosity.

After conventional edgerounding and cleaning, a considerable portion of the cubic phase on the surface was removed particularly in the area close to the edge. The inserts were coated by conventional CVD-technique with an about 6 μm layer of TiC and TiN.

EXAMPLE 6

(Reference Example to Example 5)

From the same powder as in Example 5, blanks were pressed of the same type and inserts were sintered according to the standard part of the sintering in Example 5, i.e., with a protective gas of Ar during the holding time at 1410° C. The cooling was performed under a protective gas of Ar. The structure in the surface of the insert consisted of an about 15 μm thick binder phase enriched zone essentially free from cubic phase. Below that there was a zone 100–130 μm thick considerably depleted of binder phase, with a minimum of about 30% below the nominal content of the binder phase and to the corresponding degree enriched of cubic phase. The inner of the inserts showed no C-porosity. This is a typical structure for gradient sintered cemented carbide according to known technique.

The inserts were edgerounded and coated according to Example 5.

EXAMPLE 7

With the milling inserts from Examples 5 and 6, a milling operation in a quenched and tempered steel SS 2541 was performed as a facemilling over a workpiece 50 mm thick. The milling was performed as one tooth milling with a milling body with a diameter of 125 mm. The milling body was positioned such that its center was above the exit side of the workpiece. The following cutting data were used:

Speed: 90 m/min

Feed: 0.3 mm/rev

Cutting depth: 2.0 mm

The time until insert fracture was obtained was measured for 20 edges. The average tool life was 9.3 min for the inserts according to Example 5 and 3.2 min for Example 6. It appears that a clearly improved toughness was obtained for the inserts according to the invention.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of making a binder phase enriched cemented carbide insert by sintering a cemented carbide containing a nitrogen-containing material in a vacuum or inert atmosphere, the improvement wherein after the sintering, the insert is heat treated in nitrogen at 40–400 mbar at a temperature of 1280°–1430° C. for a time of 5–100 min.

2. The process of claim 1 wherein the insert is heat treated in nitrogen at 150–300 mbar.

3. The process of claim 2 wherein the insert is heat treated at a temperature is between 1320°–1400° C.

4. The process of claim 3 wherein the insert is heat treated for a time of 10–15 minutes.

5. The process of claim 1 wherein the cemented carbide has a content of cubic phase of 8–15 weight % and is heat treated in nitrogen gas for 5–50 minutes at a temperature of 1280°–1320° C. at a pressure of 50–150 mbar.

6. The process of claim 1 wherein the cemented carbide has a content of cubic phase of 6–10 weight % and is heat treated in nitrogen gas for 5–50 minutes at a temperature of 1350°–1380° C. and a pressure of 250–350 mbar.

* * * * *